United States Patent [19]

Disch et al.

[11] Patent Number: 4,569,782

[45] Date of Patent: Feb. 11, 1986

[54] HARD SURFACE DETERGENT COMPOSITIONS CONTAINING FATTY ACID CYANAMIDES

[75] Inventors: Karlheinz Disch, Haan; Eva Kiewert, Duesseldorf; Maria Weichbrodt, Bergisch-Gladbach; Christian Hase, Erkrath, all of Fed. Rep. of Germany

[73] Assignee: Henkel Kommanditgesellschaft auf Aktien, Duesseldorf, Fed. Rep. of Germany

[21] Appl. No.: 618,794

[22] Filed: Jun. 8, 1984

[30] Foreign Application Priority Data

Jun. 9, 1983 [DE] Fed. Rep. of Germany ..... 3320727

[51] Int. Cl.[4] ..... C11D 1/02; C11D 3/32; C11D 3/48

[52] U.S. Cl. ..... 252/106; 252/141; 252/153; 252/155; 252/174.17; 252/174.21; 252/174.23; 252/525; 252/531; 252/539; 252/544; 252/550; 252/558; 252/DIG. 14

[58] Field of Search ..... 252/117, 141, 525, 544, 252/DIG. 2, DIG. 14, 531, 539, 550, 558; 564/106; 260/404.5 CN

[56] References Cited

U.S. PATENT DOCUMENTS

| | | | |
|---|---|---|---|
| 3,966,789 | 6/1976 | Oishi et al. | 260/404.5 CN |
| 4,175,062 | 11/1979 | Disch et al. | 252/540 |

FOREIGN PATENT DOCUMENTS

| | | |
|---|---|---|
| 84836 | 8/1983 | European Pat. Off. . |
| 708428 | 7/1941 | Fed. Rep. of Germany . |
| 2733790 | 2/1979 | Fed. Rep. of Germany . |
| 2840463 | 3/1980 | Fed. Rep. of Germany . |
| 2913049 | 10/1980 | Fed. Rep. of Germany . |
| 3202213 | 8/1983 | Fed. Rep. of Germany . |
| 428091 | 5/1935 | United Kingdom . |

OTHER PUBLICATIONS

A. E. Kretov, A. P. Momsenko in J. of Org. Chem. of USSR 1, (1965) pp. 1765–1767.

Encyclopedia of Polymer Science and Technology, John Wiley & Sons, (1970) vol. 12, pp. 443–446.

*Primary Examiner*—Prince E. Willis

*Attorney, Agent, or Firm*—Ernest G. Szoke; Henry E. Millson, Jr.; Mark A. Greenfield

[57] ABSTRACT

A detergent composition for hard surfaces containing a fatty acid cyanamide, a secondary (non-cyanamide) surfactant and/or a water-soluble polymer.

21 Claims, No Drawings

HARD SURFACE DETERGENT COMPOSITIONS CONTAINING FATTY ACID CYANAMIDES

BACKGROUND OF THE INVENTION

1. Field of the Invention

This invention relates to detergent compostions containing fatty acid cyanamides, useful for cleaning hard surfaces.

2. Statement of the Prior Art

Acylcyanamides, particularly fatty acid cyanamides, and their suitability as soap-like wetting agents and dispersants have been known since the thirties. Thus, German Patent No. 708,428 and British Patent No. 428,091 describe the production of acylcyanamides and a process for treating textiles therewith.

In the development of modern cleaners for hard (especially non-porous) surfaces, use is made of the improvement in effectiveness produced by certain surfactant mixtures and surfactant/polymer mixtures as compared to the respective individual components. In this way, it is possible to combine high cleaning power with careful surface treatment and high skin compatibility, because the expected cleaning effect can be obtained with low concentrations and without any need to use strongly alkaline or strongly acidic additives. Thus, a mixture of a synthetic anionic sulfonate surfactant, for example alkyl benzene sulfonate, and a synthetic anionic sulfate surfactant, for example a fatty alcohol polyglycol ether sulfate, is used as a synergistically active surfactant component in dishwashing compositions. Combinations of nonionic surfactants and synthetic anionic surfactants, for example a combination of ethoxylated diols and alkyl benzene sulfonate or alkane sulfonate have also been described as the active constituents of cleaning preparations in U.S. Pat. No. 4,175,062. A further improvement in effect is obtained by the addition of certain water-soluble polymers from the group comprising polyethylene glycols, polyvinyl alcohols, polyvinyl pyrrolidones, cellulose ethers, polysaccharides, proteins and polyacrylamides, to cleaning preparations based on nonionic and/or anionic synthetic surfactants, even small additions of polymers producing a significant improvement in effect (see German Patent Application Nos. 28 40 463 and 29 13 049).

DESCRIPTION OF THE INVENTION

It has now been found that fatty acid cyanamides, particularly those containing from 8 to 18, (preferably 12 to 16), carbon atoms in the fatty acid residue, especially in the form of their water-soluble salts, are eminently suitable for use as surfactants for cleaning hard surfaces and as an ingredient of cleaning compositions for hard surfaces, especially substantially non-porous surfaces. Surprisingly, the use of the fatty acid cyanamides together with another (different) synthetic surfactant produces a very pronounced improvement in effect. Such an improvement in effect also occurs when the fatty acid cyanamides are used together with small quantities of water-soluble polymeric substances, even when no other surfactants are present.

In the context of the invention, preparations for cleaning hard surfaces are understood to be solid, powder, paste, and liquid preparations which are used in the home, in industry and by industrial cleaning contractors for cleaning and protecting soiled surfaces. In addition to dishwashing preparations for manual dishwashing, therefore, cleaning preparations in the context of the invention include cleaning preparations for hard surfaces of metal, painted walls, coated wood, plastics, ceramic products such as porcelain, wall tiles, floor tiles, glass, and the like. These cleaning preparations may be used in undiluted or diluted form, for example by applying them to a moist absorbent cloth or to a sponge and wiping the hard surfaces to remove dust, grease, soil and stains, or by immersing the objects to be cleaned in dilute aqueous solutions of the cleaning preparations and rubbing them with a sponge, a cloth or a brush. In this connection, it is particularly desirable that the surface treatment should not leave behind any patches or streaks of the cleaning preparation and should not necessitate any aftertreatment with clear water.

The fatty acid cyanamides are best used in the form of their water-soluble salts, i.e. in the form of an alkali metal salt, such as the lithium, sodium or potassium salt, or in the form of their ammonium or alkanolammonium salts.

The fatty acid cyanamides used in accordance with the invention may also be represented by the following general formula

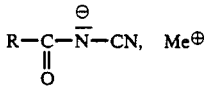

$$R-\underset{\underset{O}{\|}}{C}-\overset{\ominus}{\bar{N}}-CN,\quad Me^{\oplus} \qquad (I)$$

in which R represents a $C_{7-17}$ fatty alkyl or fatty alkenyl radical and Me+ the associated salt cation according to the above description.

Other suitable synthetic surfactants, which produce an unexpected improvement in effect when combined with the fatty acid cyanamides, are standard anionic, nonionic or amphoteric synthetic surfactants. These surfactants will be described in more detail below. In addition to the synthetic surfactants, standard soaps such as the surface-active alkali and alkanolamine salts of fatty acids, may also be used. Combinations of the cyanamides with synthetic anionic surfactants of the sulfonate and sulfate surfactant type are particularly preferred.

The above-mentioned synthetic surfactants are generally used in quantities of from 1 to 30% by weight (based on the cleaning preparation in concentrated form) together with the fatty acid cyanamides.

The water-soluble organic polymers which are used in small quantities, i.e. in quantities of from 0.01 to 2% by weight (based on the cleaning preparation used in concentrated form), include water-soluble polyethylene: glycols having molecular weights of about 300,000 to 4,000,000; water-soluble polyvinyl alcohols having molecular weights of about 13,400 to 250,000; water-soluble polyvinyl pyrrolidones having molecular weights of about 10,000 to 1,000,000; and water-soluble cellulose ethers, polysaccharides, proteins and polyacrylamides which have average molecular weights of about 2,000,000 and which, in addition, are characterized by 5,000 to 10,000,000 and preferably about 20,000 to a charge density of greater than 0, but no greater than 0.5. These water-soluble polymers may be used in accordance with the invention as additives to boost the cleaning effect, and are described below in more detail.

The salts of the fatty acid cyanamides used in accordance with the invention are colorless to slightly yellowish, brittle to wax-like substances which are solid at room temoperature. They soften at higher temperatures and melt at temperatures above 100° to 150° C. , The fatty acid cyanamide salts may be produced from carboxylic acid derivatives and cyanamide with subsequent neutralization by suitable bases (cf. German Patent No. 708,428 or A. E. Kretov and A. P. Momsenko in J. of Org. Chem. of the USSR 1 (1965), pages 1765–1767). One simple method of producing salts of cyanamide and carboxylic acid esters is described in German Patent Application No. P 32 02 213.1. In this process, the fatty acid cyanamide salts accumulate in anhydrous form. This is a significant advantage over conventional surfactants, and makes it possible to formulate powdered cleaning preparations with a high surfactant content. In addition to the fact that they are easy to produce, the salts of the fatty acid cyanamides have the advantage that they may be produced from renewable raw materials, in this case fatty acid derivatives, and the cyanamide readily obtained from nitrolime (calcium cyanamide). Accordingly, the use of these surfactants reduces dependence upon petroleum-based raw materials, as is the case with alkyl benzene sulfonate. In addition, fatty acid cyanamides may be regarded as benign to the environment by virtue of their biodegradability and their toxicological acceptability. It is preferred to use the sodium salts of the fatty acid cyanamides, particularly those derived from $C_{8-18}$, preferably $C_{12-16}$, fatty acids and their mixtures. These compounds may readily be obtained from reacting monosodium cyanamide and the methyl esters of natural fatty acids and fatty acid mixtures, such as coconut oil fatty acid methyl ester.

The cleaning preparations according to the invention are also distinguished by gentleness to the skin because of their content of fatty acid cyanamides.

In the preferred use of the fatty acid cyanamide salts in conjunction with a secondary surfactant selected from the group consisting of synthetic anionic, nonionic and amphoteric surfactants, the quantitative weight ratio of fatty acid cyanamide salt and the secondary surfactant is in the range about 9:1 to 1:9. The detergent compositions in accordance with the invention generally contain the fatty acid cyanamide salt in quantities of about 1 to 90% by weight.

Where the fatty acid cyanamide salt and the water-soluble polymer corresponding to the above definition are used together, the water-soluble polymer is always used in a much smaller quantity than the fatty acid cyanamide salt, such quantity amounting to no more than 20%, preferably 10% by weight, of the quantity of the fatty acid cyanamide salt.

In one particularly preferred embodiment, the fatty acid cyanamide salt is used together with both the secondary synthetic surfactant and the polymer, to yield an intensive cleaning composition.

General Formulation A:

The powder, paste, and liquid detergent compositions in accordance with the invention preferably contain (a) from 1 to 90% by weight of the fatty acid cyanamide salts defined above;
(b) from 0 to 90% by weight of a secondary synthetic surfactant selected from compatible anionic, nonionic, or amphoteric surfactants and mixtures thereof;
(c) from 0 to 2% by weight of a water-soluble organic polymer;
(d) from 10 to 99% by weight (i.e., the balance to 100%) of other ingredients of the type normally used in preparations for cleaning hard surfaces.

The aqueous solution cleaning preparations used in accordance with this invention are generally neutral to mildy alkaline, and should have a pH-value of about 7.0 to 10.5, preferably about 7.5 to 9.5, for concentrations of about 2 to 20 g/l, preferably about 5 to 15 g/l, of detergent in aqueous solution. For this reason, the cleaning preparations may contain in addition to the usual ingredients an acid- or alkalinereacting substance compatible with the other ingredients for regulating the pH.

General Formulation B:

A neutral cleaning preparation generally may have the following protoype formulation:

(a) from 1 to 90% by weight of the above described $C_{8-18}$ fatty acid cyanamide salt, preferably the $C_{12-16}$ fatty acid cyanamide sodium or lithium salt;
(b) from 0.5 to 90% by weight of a secondary surfactant selected from synthetic anionic, nonionic and/or amphoteric surfactants, preferably from synthetic anionic surfactants, the ratio of a:b amounting to about between 9:1 and 1:9;
(c) from 0 to 1%, preferably 0.1 to 1%, by weight of a water-soluble organic polymer as described herein;
(d) from 1 to 15% by weight of ingredients of the type commonly used in cleaning preparations such as pHregulating buffer systems, solvents, hydrotropes, viscosity regulators, antimicrobial agents, dyes and fragrances, and
(e) from 8.0 to 97.5% (i.e., the balance to 100%) by weight of a carrier such as water or solid supports.

General Formulation C:

A mildly alkaline cleaning preparation generally may have the following prototype formulation:

(a) from 1 to 90% by weight of the $C_{8-18}$ fatty acid cyanamide salt corresponding to the above description, preferably the $C_{12-16}$ fatty acid cyanamide sodium salt;
(b) from 0 to 90%, preferably 0.5 to 90%, by weight of a surfactant selected from synthetic anionic, nonionic and/or amphoteric surfactants, preferably from synthetic anionic surfactants, the ratio of a:b amounting to about between 1:1 and 1:9;
(c) from 0 to 1%, preferably 0.1 to 1%, by weight of a water-soluble organic polymer as described herein, at least one of the components b or c being present;
(d) from 1 to 90% by weight of other ingredients commonly present in dishwashing and cleaning preparations, such as builders, solvents, hydrotropes, viscosity regulators, antimicrobial agents, abrasives, dyes and fragrances; and
(e) from 9 to 98% (i.e. the balance to 100%) by weight of a carrier such as water or solid (preferably inert) supports.

In the context of this invention, solid supports are understood to be neutrally reacting, organic or inorganic salts, finely dispersed silicas, layer lattice silicates and aluminosilicates and similar substances compatible with the other ingredients.

The essential ingredients of the cleaning preparations used in conjuction with the fatty acid cyanamide salts will now be described in more detail.

Suitable synthetic anionic secondary surfactants, which may be used together with the fatty acid cyanamide salts, are in particular those of the sulfonate and sulfate type.

The sulfonate surfactants are, primarily, the alkyl benzene sulfonates containing $C_{9-15}$-alkyl groups and the esters of α-sulfofatty acids, for example α-sulfonated methyl or ethyl esters of hydrogenated coconut oil, palm kernel oil or tallow fatty acids. Other suitable surfactants of the sulfonate type are the alkane sulfonates obtainable from $C_{12-18}$-alkanes by sulfochlorination or sulfoxidation, followed by hydrolysis or neutralization, or by the addition of bisulfites onto olefins. Also suitable are olefin sulfonates, i.e. mixtures of alkene and hydroxy alkane sulfonates and disulfonates of the type obtained from monoolefins containing a terminal or internal double bond by sulfonation with gaseous sulfur trioxide, followed by alkaline and acidic hydrolysis of the sulfonation products.

Particularly suitable surfactants of the sulfate type are the sulfuric acid monoesters of primary alcohols of natural and synthetic origin, i.e. fatty alcohols such as coconut oil fatty alcohols, tallow fatty alcohols, oleyl alcohols, or the $C_{10-20}$-oxoalcohols, and those of secondary alcohols having chain lengths in that range. Other suitable sulfate surfactants are the sulfuric acid monoesters of aliphatic primary alcohols ethoxylated with from 1 to 6 mols of ethylene oxide and ethoxylated secondary alcohols or alkyl phenols. Sulfated fatty acid alkanolamides and sulfated fatty acid monoglycerides are also suitable.

All these anionic surfactants are preferably in the form of their salts, particularly the sodium salts, but also the potassium or ammonium salts, or soluble salts of organic bases such as mono-, di- or triethanolamine. Particularly favorable performance properties are exhibited by detergent compositions which contain about 1 to 60% by weight of a fatty acid cyanamide salt and about 1 to 30% by weight of a synthetic anionic secondary surfactant selected from the group comprising alkyl benzene sulfonates, ester sulfonates, alcohol sulfates and mixtures thereof, in addition to other standard ingredients of washing and cleaning preparations.

Typical nonionic secondary surfactants are adducts of about 1 to 40 and preferably about 2 to 20 mols of ethylene oxide with 1 mol of a $C_{10-20}$ aliphatic compound selected from the group comprising alcohols, alkyl phenols, carboxylic acids and carboxylic acid amides. Particularly useful are the adducts of about 8 to 20 mols of ethylene oxide with primary alcohols such as coconut oil or tallow fatty alcohols; oleyl alcohol; oxoalcohols having corresponding chain lengths or corresponding secondary alcohols; and mono- or dialkyl phenols containing from 6 to 14 carbon atoms in the alkyl radicals. In addition to these water-soluble nonionics, water-insoluble or substantially water-insoluble polyglycol ethers containing about 2 to 7 ethylene glycol ether residues in the molecule are also of interest, particularly when they are used in conjunction with water-soluble nonionic or anionic surfactants. By virtue of their favorable biodegradability, particular practical interest is attributed above all to the ethoxylation products of primary aliphatic alkanols and alkenols.

Typical nonionic secondary surfactants having an average degree of ethoxylation of about 2 to 7 which are suitable include: coconut oil fatty alcohol-3 E.O (E.O.=ethylene oxide); tallow fatty alcohol-5 E.O oleyl/cetyl alcohol-5 E.O (iodine number 30 to 50); tallow fatty alcohol-7 E.O synthetic $C_{12-16}$-fatty alcohol-6 E.O; $C_{11-15}$-oxoalcohol-3 E.O; $C_{14-15}$-oxo alcohol-7 E.O; i-$C_{15-17}$-alkane diol-5 E.O (i=internal); and sec.-$C_{11-15}$-alcohol-4 E.O.

Examples of nonionic secondary surfactants having an average degree of ethoxylation of about 8 to 20, preferably about 9 to 15, are: coconut oil fatty alcohol-12 E.O; synthetic $C_{12-14}$-fatty alcohol-9 E.O; oleyl/cetyl alcohol-10 E.O; tallow fatty alcohol-14 E.O.; $C_{11-15}$-oxoalcohol-13 E.O.; $C_{15-18}$-oxoalcohol-15 E.O; i-$C_{15-17}$-alkane diol-9 E.O; $C_{14-15}$-oxoalcohol-11 E.O; and sec.-$C_{11-15}$-alcohol-9 E.O.

Other suitable nonionic secondary surfactants are the water-soluble adducts—containing about 20 to 250 ethylene glycol ether groups and about 10 to 100 propylene glycol ether groups—of ethylene oxide with polypropylene glycol, alkylene diamine-polypropylene glycol and with $C_{1-10}$-alkyl polypropylene glycols in which the polypropylene glycol chain functions as a hydrophobic residue. Other suitable nonionic surfactants are amine oxides or sulfoxides, such as: N-coco-alkyl-N,N-dimethylamine oxide; N-hexadecyl-N,N-bis(2,3-dihydroxypropyl)-amine oxide; and N-tallow alkyl-N,N-dihydroxyethylamine oxide.

Suitable amphoteric secondary surfactants are those whose molecules contain: acidic groups, such as carboxyl, sulfonic acid, sulfuric acid semiester, phosphonic acid and phosphoric acid partial ester groups; as well as basic groups, such as primary. secondary. tertiary and quaternary ammonium groups. Amphoteric surfactant compounds containing quaternary ammonium groups are betaine compounds, i.e., are bases which are polar and zwitterionic. Amphoteric compounds such as these are, in particular, derivatives of aliphatic quaternary ammonium compounds in which one of the aliphatic radicals consists of a $C_{8-18}$-radical and another contains an anionic water-solubilizing carboxy, sulfo or sulfato group. Typical representatives of useful surface-active betaines are: 3-(N-hexadecyl-N,N-dimethylammonio-propane sulfonate; 3-(N-tallow alkyl-N,N-dimethylammonio)-2-hydroxypropane sulfonate; 3-(N-hexadecyl-N,N-bis-(2-hydroxyethyl)-ammonio)-2-hydroxypropyl sulfate; 3-(N-cocoalkyl-N,N-bis-(2,3-dihydroxypropyl)-ammonio)-propane sulfonate; N-tetradecyl-N,N-dimethylammonioacetate; and N-hexadecyl-N,N-bis-(2,3-dihydroxypropyl)-ammonioacetate.

Water-soluble organic polymers suitable for use in accordance with the invention include water-soluble polyethylene glycols having a molcular weight of about 300,000 to 4,000,000 (preferably about 500,000 to 1,000,000) which are produced in a known manner by subjecting ethylene glycols to polycondensation. They may also be regarded as condensation polymers of ethylene oxide with ethylene glycol or water. They correspond to the general formula $HO(—CH_2—CH_2—O)_nH$, in which n may vary between 4,800 and 64,600 in the case of the polyethylene glycols used in accordance with the invention. Polymers such as these are commercially available and are marketed, among others, by Union Carbide Corporation under the trademark "POLYOX".

Other suitable water-soluble polymers include polyvinyl alcohols and polyvinyl pyrrolidones. Polyvinyl alcohols can be produced by the hydrolysis of polyvinyl acetate. They correspond to the general formula $(—CH_2—CH(OH)—n$ and have molecular weights of about 13,400 to 250,000 (preferably about 80,000 to 100,000). They may still contain small residues of acetyl radicals from the hydrolysis reaction, although these should amount to less than 40%, preferably less than 15%, more preferably less than 2% and, better still, 0%. Polyvinyl alcohols are marketed, among others, by Wacker-Chemie under the trademark "POLYVIOL" and by Nippon Gohsei under the trademark "GOHSENOLE".

Polyvinyl pyrrolidones are also commerically available useful polymers. They are marketed, among others, by BASF under the trademark "LUVISKOLE". For use in accordance with the invention, they should have a degree of polymerization of about 100 to 9,000 and preferably about 350 to 7,500 and molecular weights of about 10,000 to 1,000,000 and preferably about 30,000 to 850,000.

Cellulose ethers, polysaccharides, proteins and polyacrylamides are water-soluble, weakly anionic polymers, according to their degree of substitution or reaction. Weakly anionic polymers are understood to be polymers whose charge density is greater than 0, but no greater than 0.5, preferably no greater than 0.2, more preferably no greater than 0.01. The charge density is defined by the following equation:

$$\text{charge density} = \frac{\text{number of dissociable groups per macro molecule}}{\text{degree of polymerization } n}.$$

Cellulose ethers having a charge density within the above parameters include above all those of which a 2% aqueous solution has a viscosity at 20° C. of greater than 50 m Pa . s and preferably of greater than 100 m Pa. s. Cellulose ethers such as these include the methyl celluloses (MC), methyl hydroxyethyl celluloses (MHEC), methyl hydroxypropyl celluloses (MHPC), carboxymethyl methyl cellulose (CMMC) and hydroxyethyl celluloses (HEC) marketed collectively by Henkel under the trademark "CULMINAL", as well as methylhydroxybutyl cellulose (MHBC) and hydroxybutyl cellulose of the type marketed by Dow Chemicals under the trademark "METHOCEL". These cellulose ethers are preferred among the anionic polymers.

Polysaccharides are used in particular in the form of derivatives, such as starch ethers (for example "SOLVITOSE", a product of W. A. Scholtens, Holland), the above charge densities being critical. Alginates such as "ALGIPON", a Henkel product, also belong to this class of polymers.

Proteins suitable for use in accordance with the invention are sodium caseinate and gelatin, both of which are marketed, among others, by the Milac Company of Hamburg, Germany.

Polyacrylamides, i.e. polymers and copolymers of acrylamide corresponding to the general formula , $(-CH_2-CH(CONH_2)-)_n$ having a molecular weight in the range about 300,000 to 6,000,000 and preferably about 500,000 to 2,000,000, are marketed, among others, by the Schuchardt company and are also suitable for use in accordance with this invention.

Acidic substances suitable for pH-regulation include the usual inorganic or organic acids or acid salts, such as: hydrochloric acid; sulfuric acid; bisulfates of the alkali metals; aminosulfonic acid; phosphoric acid or other acids of phosphorus, particularly the anydrous acids of phosphorus or their salts or their acid-reacting solid compounds with urea or other lower carboxylic acid amides, partial amides phosphoric acids or of anhydrous phosphoric acid; citric acid; tartaric acid; lactic acid; and the like. Organic or inorganic compounds, such as alkanolamines, i.e. mono-, di- or triethanolamine, or ammonia may also be added as bases. In addition, alkaline-reacting builders and washing alkalis, such as sodium tripolyphosphate, sodium carbonate and sodium bicarbonate, potassium carbonate and potassium bicarbonate, sodium silicate and also sodium aluminosilicates, are suitable for adjusting a weakly alkaline pH-value.

To produce the cleaning preparations in liquid form, it is possible to incorporate known solution promoters including water-soluble organic solvents, such as low molecular weight aliphatic alcohols containing from 1 to 4 carbon atoms. It is also possible to use hydrotropic substances of the lower alkylaryl sulfonate type, for example toluene, xylene or cumene sulfonates. These may also be used in the form of their sodium and/or potassium and/or alkylamino salts. Other suitable solution promoters are water-soluble organic solvents having boiling points above 75° C., such as the ethers of polyhydric alcohols of the same or of different types or the partial ethers of polyhydric alcohols, including di-or triethylene glycol polyglycerols, and the partial ethers of ethylene glycol, propylene glycol, butylene glycol or glycerol with aliphatic monohydric alcohols containing from 1 to 4 carbon atoms in the molecule.

Other suitable solvents are soluble in or emulsifiable with water and include: ketones, such as acetone or methylethyl ketone; aliphatic, cycloaliphatic, aromatic and chlorinated hydrocarbons; and the terpene alcohols.

To regulate viscosity, it may be advisable in some cases to add higher polyglycol ethers having molecular weights of up to about 600 or polyglycerol. An addition of sodium chloride and/or urea is also recommended for viscosity regulation.

The detergent compositions may also contain small additions of dyes and fragrances, preservatives and, if desired, antimicrobial agents of any kind, none of which affect the detergent efficacy.

Preferred antimicrobial agents are formaldehyde-aminoalcohol condensation products which are obtained by reacting an aqueous solution of formaldehyde with aminoalcohols, for example 2-aminoethanol, 1-aminoethanol, 1-amino-2-propanol, 2-amino-isobutanol, and/or 2-(2'-aminoethyl)-aminoethanol.

In addition, the cleaning preparations may contain any organic or inorganic abrasives, if desired. The powder consistency of the fatty acid cyanamide salts is again of particular advantage for the production of souring powders.

EXAMPLES 1-3

The "dish test" was used for demonstrating the cleaning effect of detergent compositions in accordance with this invention for manual dishwashing. This test is described in the journal "Fette, Seifen, Anstrichmittel", 74 (1972), pages 163 to 165.

Briefly, dishes were soiled with a mixture of egg white, grease and carbohydrates and washed at 45° C. The tested products were used in a quantity of 0.1 g/l in the case of powders and in a quantity of 0.4 g/l in the the basis of the number of dishes which are washed case of liquids. The cleaning effect was assessed on clean with 5 liters of washing solution (dish count).

EXAMPLE 1

Dishwashing powder

The following constituents (in % by weight) were mixed together:

54.0% of $C_{12-16}$-fatty acid cyanamide-Na-salt 18.0% of $C_{11-13}$-alkylbenzene sulfonate, Na-salt (secondary surfactant)

13.5% of $C_{12-14}$-fatty alcohol-2E.O-sulfate, Na-salt (secondary surfactant)
4.5% of coconut oil fatty acid diethanolamide
0.8% of borax, anhydrous,
1.0% of boric acid
balance to 100% Na-sulfate, dyes and fragrances.

21 dishes could be washed clean with this powder.

EXAMPLES 1a,b—COMPARATIVE

When the three-surfactant combination of Example 1 is replaced by the same quantity of the following individual secondary surfactants, the following test results are obtained under the same test conditions:

(a) $C_{12-14}$-fatty alcohol-2E.O-sulfate, Na-salt: dish count=15
(b) $C_{11-13}$-alkylbenzene sulfonate, Na-salt: dish count=11.

The synergistic effect of the surfactant combination containing $C_{12-16}$-fatty acid cyanamide-Na-salt is clearly apparent.

EXAMPLE 2

Dishwashing liquid (quantities in percent by weight)

16.0% of $C_{14}$-fatty acid cyanamide-Na-salt
4.0% of $C_{12-14}$-fatty alcohol-2E.O-sulfate, Na-salt (secondary surfactant)
5.0% of ethanol
5.0% of urea
0.1% of 2-hydroxy-2',4,4'-tricholordiphenylether as antimicrobial agent
balance to 100% water, dyes and fragrances.
Dish count=22.

EXAMPLE 2—COMPARATIVE

If, in Example 2, the fatty acid cyanamide salt is replaced by $C_{11-13}$-alkylbenzene sulfonate, Na-salt, the same test produces a dish count of 16.

EXAMPLE 3

Dishwashing liquid (quantities in percent by weight)

12.0% of $C_{12-16}$-fatty acid cyanamide-Na-salt
12.0% of $C_{12-14}$-fatty alcohol-2E.O-sulfate, Na-salt (secondary surfactant)
4.0% of ethanol
8.0% of urea
balance to 100% water, dyes and fragrances.
Dish count=23.

EXAMPLE 3 —COMPARATIVE

If, in Example 3, the fatty acid cyanamide salt is replaced by the alkylbenzene sulfonate, a dish count of 17 is obtained.

EXAMPLES 4–7

The following Examples relate to multipurpose liquid cleaning preparations. The cleaning power of the formulations containing the combination of fatty acid cyanamide salt plus a secondary surfactant or polymeric substance was determined by the following method:

Test Method

The cleaning preparation to be tested is applied to an artificially soiled plastic surface. A mixture of soot, machine oil, saturated fatty acid triglyceride and low-boiling aliphatic hydrocarbon is used as the artificial soil. The test surface measuring 26×28 cm is uniformly coated with 2 g of the artificial soil by means of a surface coater.

A plastic sponge is impregnated with 12 ml of the particular cleaning preparation solution to be tested and moved by machine over the test surface. After 6 wipes, the cleaned test surface is held under running water and the loose soil removed. The cleaning effect, i.e. the whiteness of the plastic surface thus cleaned, is measured by means of a photoelectric colorimeter (type LF 90, Dr. B. Lange). The clean white plastic surface is used as the whiteness standard.

Since the cleaned surface is rated at 100% and the soiled surface at 0% on the measurement scale, the values read off for the cleaned plastic surfaces can be equated with the percentage cleaning power (% CP). In the following tests, the % CP-values quoted are the values determined by this method for the cleaning power of the cleaning preparations tested. They each represent average values of 4 measurements.

This method provides for a readily reproducible comparison as long as identical test materials are used.

EXAMPLE 4

Weakly alkaline, liquid cleaner (quantities in percent by weight)

2.0% of lauric acid cyanamide-Na-salt
8.0% of $C_{11-13}$-alkylbenzene sulfonate, Na-salt (secondary surfactant)
3.0% of pentasodium tripolyphosphate
2.0% of Na-cumene sulfonate balance to 100% water, dyes and fragrances.

When tested by the method described above, the cleaner of Example 4 in the form of a 1% solution in tapwater (hardness 16°d) at room temperature gave a value of 65% CP.

EXAMPLES 4a,b—COMPARATIVE

If, by contrast, the surfactant combination is replaced by the same quantity of the particular individual surfactant indicated, the following values are obtained under the same test conditions: (a) total quantity of surfactant in the form of alkylbenzene sulfonate: 60% CP (b) total quantity of surfactant in the form of lauric acid cyanamide salt: 52% CP.

The chemically synergistic effect obtained in this case by combining both surfactants in a ratio of 1:4 is clearly apparent.

EXAMPLES 5a,b

Weakly alkaline liquid cleaner (quantities in percent by weight)

10.0% of $C_{12-18}$-fatty acid cyanamide
(a)=Na-salt
(b) =Li-salt
3.0% of pentasodium tripolyphosphate
0.2% of polyethylene glycol having a molecular weight of approximately 600,000 ("POLYOX WSR 205", a trademark of Union Carbide Corp.) (water-soluble polymer).
5.0% of urea
balance to 100% water, dyes and fragrances.
CP-value of a 1% solution in tapwater
(a)=74% CP,
(b)=75% CP.

EXAMPLES 5a,b—COMPARATIVE (a) A commercially available domestic cleaner containing 8.5% of $C_{12-18}$-alkane sulfonate+2.8% of aliphatic nonionic surfactant and also 4% of pentasodium tripolyphosphate was tested for comparison. In the form of a 1% solution, it showed a CP-value of 42%.

(b) For further comparison, the fatty acid cyanamide salt in Example 5a was replaced by the same quantity of $C_{12-18}$-alkane sulfonate. A CP-value of 50% was obtained in this case. This Example shows that small additions of polymers greatly enhance the cleaning effect of fatty acid cyanamide salts, so that detergent compositions containing the combination are superior to those of the prior art.

EXAMPLES 6a,b

Weakly alkaline liquid cleaner (quantities in percent by weight)

2.0% of fatty acid cyanamide-Na-salt
(a) fatty acid residue=$C_{12-16}$
(b) fatty acid residue=$C_{14-18}$
8.0% of $C_{11-13}$-alkylbenzene sulfonate, Na-salt (secondary surfactant)
3.0% of pentasodium tripolyphosphate
0.2% of POLYOX WSR 205, as in Examples 5 (water-soluble polymer)
5.0% of urea
2.0% of butyl glycol
balance to 100% water, dyes and fragrances.
CP of a 1% solution, Example
(6a): 85%,
(6b) 75%.

EXAMPLE 6—COMPARATIVE

If, in Examples 6, the fatty acid cyanamide salts are replaced by the same quantities of a $C_{11-14}$-alkane diol+10 E.O., a CP-value of 70% is obtained. This Example shows that, where a synergistic surfactant combination with fatty acid cyanamide salts and a polymer are simultaneously used, a greater improvement in effect is obtained than with known substances already rated as highly active.

EXAMPLES 7a,b

A weakly alkaline, disinfecting cleaner (quantities in percent by weight)

6.0% of $C_{12-16}$ fatty acid cyanamide-Na-salt
6.0% of $C_{11-13}$-alkylbenzene sulfonate, Na-salt (secondary surfactant)
(a) 0.1% of POLYOX WSR 205 (cf. Examples 5) (water-soluble polymer)
(b) 0.3% of methylhydroxy propyl cellulose (water-soluble polymer)
3.0% of cumene sulfonate
15.0% of formaldehyde/monoethanolamine adduct as antimicrobial agent
balance to 100% water, dyes and fragrances.
CP of 1% solutions, Examples 7a: 85%; 7b: 73%.

These Examples show that, even in the absence of builders, the fatty acid cyanamide salts produce good cleaning results.

We claim:

1. A detergent composition for hard surfaces consisting essentially of:

(a) at least one acylcyanamide salt anionic surfactant present in about 1 to 90% by weight, having the formula

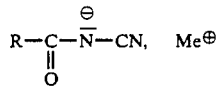

in which Me is lithium, sodium, potassium, ammonium or alkanolammonium and R is a $C_{7-17}$ fatty alkyl or fatty alkenyl;

(b) 0 to about 90% by weight of a secondary surfactant selected from other compatible anionic, nonionic, or amphoteric surfactants, or any mixture thereof;

(c) 0 to about 2% by weight of at least one water-soluble organic polymer; and (d) at least one auxiliary additive selected from pH-regulating buffer systems, solvents, hydrotropes, viscosity regulators, builders, abrasives, antimicrobial agents, dyes, or fragrances, as well as a liquid or solid inert carrier, to a balance of 100% by weight;

with the proviso that either (b) is present in at least 0.5% by weight or (c) is present in at least 0.01% by weight, or both are present in at least said amounts.

2. A detergent composition for hard surfaces consisting essentially of:

(a) at least one acylcyanamide salt anionic surfactant present in about 1 to 90% by weight, having the formula

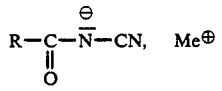

in which Me is lithium, sodium, potassium, ammonium or alkanolammonium and R is a $C_{7-17}$ fatty alkyl or fatty alkenyl;

(b) 0.5 to about 90% by weight of a secondary surfactant selected from other compatible anionic, nonionic, or amphoteric surfactants, or any mixture thereof; the weight ratio of a:b being between about 9:1 and 1:9, (c) 0 to about 2% by weight of at least one water-soluble organic polymer; and (d) at least one auxiliary additive selected from pH-regulating buffer systems, solvents, hydrotropes, viscosity regulators, builders, abrasives, antimicrobial agents, dyes, or fragrances, as well as a liquid or solid inert carrier, to a balance of 100% by weight;

with the proviso that if (c) is present, it is present in at least 0.01% by weight.

3. The detergent composition of claim 2 wherein said cyanamide salt is present in about 1 to 60% by weight and said secondary surfactant is present in about 1 to 30% by weight.

4. The detergent composition of claim 1 wherein said water-soluble polymer is present in up to about 20% by weight of said cyanamide, but not exceeding detergent composition.

5. The detergent composition of claim 4 wherein said water-soluble polymer is present in up to about 10% by weight of said cyanamide, but not exceeding about 1% by weight of the total weight of the detergent composition.

6. The detergent composition of claim 2 wherein said water-soluble polymer is present in up to about 20% by weight of said cyanamide, but not exceeding about 2% by weight of the total weight of the detergent composition.

7. The detergent composition of claim 3 wherein said water-soluble polymer is present in up to about 10% by weight of said cyanamide, but not exceeding about 1% by weight of the total weight of the detergent composition.

8. The detergent composition of claim 1 comprising a neutral cleaning preparation wherein:

(a) said cyanamide is a $C_{12-16}$ fatty acid cyanamide sodium or lithium salt present in about 1 to 90% by weight;

(b) said secondary surfactant is an anionic sulfate or sulfonate, present in about 0.5 to 90% by weight, and the weight ratio of cyanamide to secondary surfactant is between 9:1 and 1:9;

(c) said water-soluble organic polymer is present in about 0.1 to 1%;

(d) at least one auxiliary additive is present in about, 1 to 15% by weight and is a:

pH-regulating buffer system, solvent, hydrotrope, viscosity regulator, antimicrobial agent dye, or fragrance; and (e) a carrier is present in an amount sufficient to balance said detergent composition to 100% by weight, and is water or a solid support which is least one of: neutrally reacting, organic or inorganic salts; finely dispersed silicas; layer lattice silicates; or aluminosilicates.

9. The detergent composition of claim 1 comprising a mildly alkaline cleaning preparation wherein:

(a) said cyanamide is a $C_{12-16}$ fatty acid cyanamide sodium or lithium salt present in about 1 to 90% by weight;

(b) said secondary surfactant is an anionic sulfate or sulfonate, present in about 0.5 to 90% by weight, and the weight ratio of cyanamide to secondary surfactant is between 9:1 and 1:9;

(c) said water-soluble organic polymer is present in about 0.1 to 1%;

(d) at least one auxiliary additive is present in about 1 to 90% by weight and is a: builder, solvent, hydrotrope, viscosity regulator, antimicrobial agent, abrasive, dye, or fragrance; and (e) a carrier is present in an amount sufficient to balance said detergent composition to 100% by weight, and is water or a solid support which is at least one of: neutrally reacting, organic or inorganic salts; finely dispersed silicas; layer lattice silicates; or aluminosilicates.

10. The detergent composition of any one of claims 2 or 3–7 wherein said cyanamide is a $C_{12-16}$ fatty acid cyanamide sodium or lithium salt, or any mixture thereof.

11. The detergent composition of claim 1,2,3,6 or 7 wherein said secondary surfactant is an anionic surfactant which is a sulfonate or sulfate;

a nonionic surfactant which is an adduct of about 1 to 40 mols of ethylene oxide with 1 mol of a $C_{10-20}$ aliphatic alcohol, alkyl phenol, carboxylic acid, or carboxylic acid amide;

an amphoteric surfactant whose molecule contains an acidic group which is carboxyl, sulfonic acid, sulfuric acid semiester, phosphonic acid or phosphoric acid partial ester, or a basic group which is a primary, secondary, tertiary, or quaternary ammonium; or a mixture of any of the foregoing.

12. The detergent composition of claim 1,4,5,6,7,8, or 9 wherein said water-soluble polymer is: polyethylene glycols having molecular weights of about 300,000 to 4,000,000, polyvinyl alcohols having molecular weights of about 13,400 to 250,000; polyvinyl pyrrolidones having molecular weights of about 10,000 to 1,000,000; cellulose ethers, polysaccharides, proteins or polyacrylamides having average molecular weights of about 20,000 to 2,000,000 and a charge density of greater than 0 but no greater than 0.5; or a mixture of any of the foregoing.

13. The detergent composition of claim 1 wherein said cyanamide is present in about 50 to 60% by weight and said secondary surfactant is at least two surfactants present in a total of 21 to 42% by weight.

14. The detergent composition of claim 13 wherein said secondary surfactant is a first anionic surfactant which is a sulfonate present in about 13 to 23% by weight and a second anionic surfactant which is a sulfate present in about 8 to 19% by weight.

15. The detergent composition of claim 14 wherein: said cyanamide is a $C_{12-16}$-fatty acid cyanamide-Na-salt; said sulfonate is a $C_{11-13}$alkylbenzene sulfonate-Na-salt; and said sulfate is a $C_{12-14}$-fatty alcohol-2E.O-sulfate-Na salt.

16. The detergent composition of claim 1 wherein: said cyanamide is present in about 1 to 20% by weight; said secondary surfactant is present in about 2 to 20% by weight; and the weight ratio of cyanamide to secondary surfactant is between about 5:1 and 1:5.

17. The detergent composition of claim 16 wherein: said cyanamide is present in about 1 to 17% by weight and is a $C_{14}$-fatty acid cyanamide-Na-salt, a $C_{12-16}$-fatty acid cyanamide-Na-salt, a lauric acid cyanamide-Na-salt, or a mixture thereof; said secondary surfactant is present in about 3 to 13% by weight and is a $C_{12-14}$-fatty alcohol-2E.O.-sulfate-Na salt, or a $C_{11-13}$-alkylbenzene sulfonate-Na salt; and the weight ratio of cyanamide to secondary surfactant is between about 4:1 and 1:4.

18. The detergent composition of claim 1 wherein: said cyanamide is present in about 5 to 15% by weight; and said water-soluble polymer is present in about 0.01 to 1.0% by weight.

19. The detergent composition of claim 18 wherein: said cyanamide is present in about 9 to 11% by weight and is a $C_{12-18}$-fatty acid cyanamide-Na-salt, -Li-salt, or a mixture thereof; and said water-soluble polymer is present in about 0.1 to 0.3% by weight and is a polyethylene glycol having a molecular weight of approximately 600,000.

20. The detergent composition of claim 1 wherein: said cyanamide is present in about 1 to 10% by weight; said secondary surfactant is present in about 2 to 12% by weight; said water-soluble polymer is present in about 0.01 to 1.0% by weight; and the weight ratio of said cyanamide to said secondary surfactant is about 2:1 to 1:5.

21. The detergent composition of claim 20 wherein: said cyanamide is present in about 1 to 7% by weight and is a $C_{12-16}$-or a $C_{14-18}$-fatty acid cyanamide-Na-salt; said secondary surfactant is present in about 5 to 9% by weight and is a $C_{11-13}$-alkylbenzene sulfonate-Na-salt; said water-soluble polymer is present in about 0.05 to 0.4% by weight and is a polyethylene glycol having a molecular weight of approximately 600,000; and the weight ratio of said cyanamide to said secondary surfactant is about 1:1–4.

* * * * *